United States Patent [19]

DeMuro et al.

[11] 3,972,126

[45] Aug. 3, 1976

[54] METHOD AND APPARATUS FOR DRYING HAIR

[76] Inventors: Frank P. DeMuro, 3324 Secor Road, Apt. No. 9, Toledo, Ohio 43606; Norman G. Rapino, 2220 Robinwood Ave., Toledo, Ohio 43620

[22] Filed: July 18, 1974

[21] Appl. No.: 489,475

[52] U.S. Cl. ..... 34/3; 34/100; 34/99

[51] Int. Cl.[2] ..... A45D 20/24

[58] Field of Search ..... 34/96–101, 34/3, 90, 76, 77, 78; 132/7, 9

[56] References Cited

UNITED STATES PATENTS

| | | | |
|---|---|---|---|
| 1,541,988 | 6/1925 | Meyer | 34/3 |
| 1,993,244 | 3/1935 | Martin | 34/46 |
| 2,189,430 | 2/1940 | McClure | 34/3 |
| 2,293,161 | 8/1942 | Miller | 34/100 |
| 2,293,803 | 8/1942 | Colborn | 34/100 |
| 2,314,101 | 3/1943 | Phipps | 34/100 |
| 2,335,553 | 11/1943 | Valverde | 34/100 |
| 2,481,645 | 9/1949 | Conill | 34/99 |
| 2,527,745 | 10/1950 | Lawrence | 34/100 |
| 2,762,133 | 9/1956 | Leclabart | 34/100 |
| 3,364,590 | 1/1968 | Collins | 34/100 |

FOREIGN PATENTS OR APPLICATIONS

| | | | |
|---|---|---|---|
| 1,459,938 | 10/1966 | France | 34/99 |
| 985,985 | 3/1965 | United Kingdom | 34/97 |

*Primary Examiner*—John J. Camby
*Assistant Examiner*—James C. Yeung
*Attorney, Agent, or Firm*—Richard D. Emch

[57] ABSTRACT

A method and apparatus for drying hair is disclosed. A helmet defines a space adjacent the hair and vacuum apparatus reduces the air pressure within the space. Infrared lamps apply infrared radiation to the hair and the moisture bearing fluid is removed from the space by a pump. In some embodiments, the fluid is dehumidified and recirculated. Preferably, temperature and pressure controls are provided and, in some embodiments, a co-solvent is added to a recirculated air stream.

19 Claims, 5 Drawing Figures

METHOD AND APPARATUS FOR DRYING HAIR

BACKGROUND OF THE INVENTION

Apparatus for drying hair both in the home and in commercial establishments are well known in the art. Many prior art apparatus and methods include the use of heat as a primary drying agent. Several types of heat sources have been utilized including infrared radiation such as shown in U.S. Pat. Nos. 2,458,901 and 3,289,679.

The major problem with prior art methods and apparatus is the time involved in the drying operation. Many of these prior art apparatus are greatly affected by the relative humidity of the surrounding ambient air. A high relative humidity extends the drying time to the discomfort and inconvenience of the user.

SUMMARY OF THE INVENTION

The present invention is directed to a method and apparatus for drying hair which includes establishing a space surrounding the hair to be dried which is separate from the ambient atmosphere. The air pressure within the space is reduced, particularly near the hair itself, and infrared radiation is applied to the hair.

More specifically, a helmet is placed around the user's head and defines a space adjacent the hair to be dried. Vacuum means are supplied for reducing the air pressure within the space and infrared means, for example infrared lamps, are provided within the space for directing radiant energy toward the hair. Moisture containing fluid in the form of vapor is removed from the space, for example, by a pump or blower. Temperature and pressure controls are provided to control the temperature and pressure within the space.

In one embodiment, the fluid removed from the space is dehumidified and the air is recirculated back to the space. Co-solvent apparatus is provided in one such embodiment to add a co-solvent to the recirculated air stream.

DESCRIPTION OF THE PREFERRED EMBODIMENTS

Figures 1, 2:
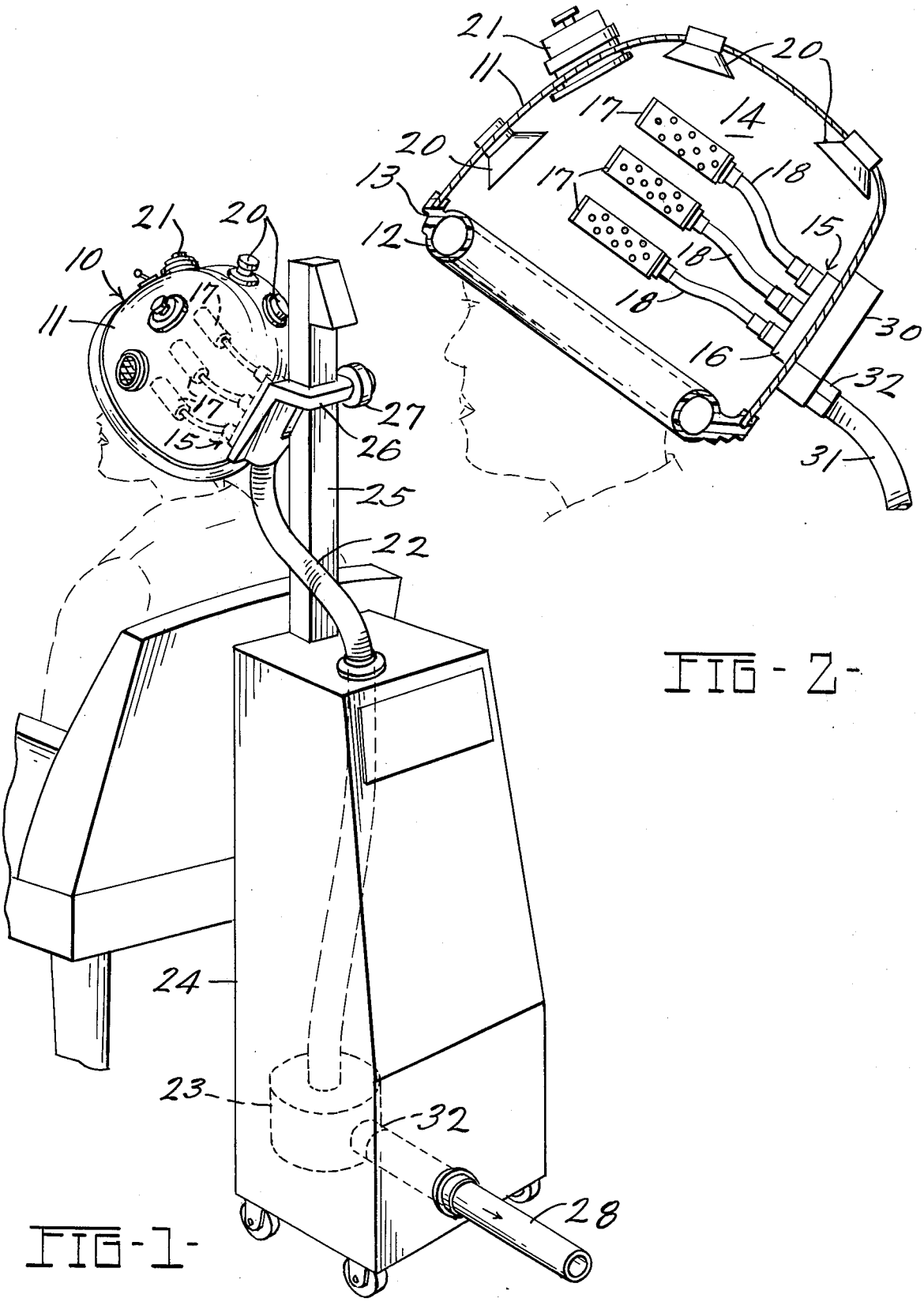
FIG. 1 is a perspective view of one embodiment of hair dryer apparatus according to the present invention.
FIG. 2 is another embodiment of hair dryer apparatus, according to the present invention, which is particularly adapted for home use.

A hair dryer, according to the present invention, is generally indicated in FIG. 1 by the reference number 10. The hair drying apparatus 10 includes a helmet 11, which is generally dome-shaped and includes a seal 12 which surrounds an open end 13 of the helmet 11. In the present embodiment, the seal 12 is constructed of an elastomeric material which contacts the user's head (see FIG. 2) and defines a space 14 between the interior of the helmet 11 and the user's head. Vacuum means, generally indicated by the reference number 15, are mounted on the helmet 11 and include a manifold 16 and at least one vacuum head. In the present embodiment, the vacuum means comprises a plurality of perforated rollers 17 which are connected by rigid or semi-rigid lines 18 to the manifold 16. The rollers 17 are supported by the helmet 11 and are positioned as close to a user's head as possible.

Infrared means, for example a plurality of infrared lamps 20, are mounted within the helmet 11 and direct radiant energy toward the user's hair. A pressure relief valve 21 is mounted by the helmet 11 and is in communication with the space 14 and the atmosphere exterior of the helmet 11. The pressure relief valve 21 vents the space 14 to atmosphere when the pressure within the space 14 drops to a predetermined pressure level. The pressure relief valve 21 serves both as a safety valve and also as a source of make-up air.

Referring to FIG. 1, a flexible conduit 22 is in communication with the vacuum means 15 and with a blower 23. A fluid pump (not shown) can be used in place of the blower 23. The embodiment shown in FIG. 1 includes a portable housing 24 and the blower 23 is positioned within the housing 24. An arm 25 extends upwardly from the housing 24 and mounts the helmet 11 by a bracket 26. A knob 27 is mounted on the bracket 26. By rotating the knob 27, the bracket 26 may be moved relative to the arm 25 to elevate or lower the position of the helmet 11. While only one helmet 11 has been shown in the drawings with respect to the housing 24, a plurality of helmets 11 may be utilized in connection with one housing 24.

In the present embodiment, the blower 23 has a discharge line 28 which vents the moisture laden air to atmosphere. Preferably, the discharge line 28 extends outwardly through the exterior wall of the commercial building. In this manner, the relative humidity of the atmosphere adjacent the helmet 11 is not substantially increased.

The embodiment shown in FIG. 2 is essentially the same as the embodiment shown in FIG. 1, however, the FIG. 2 embodiment does not include a housing. Rather, a blower unit 30 is mounted directly to the back of the helmet 11 and includes a discharge line 31 for discharging moisture laden air from the space 14. The embodiment shown in FIG. 2 is particularly adaptable to home use. In both of the embodiments shown in FIGS. 1 and 2, a thermally actuated switch 32 is provided adjacent the blower unit 23 or the blower unit 30. The switch 32 opens the circuit to the infrared lamps 20 when the temperature sensed reaches a predetermined upper level.

In operation, the hair drying apparatus 10 is actuated by closing the electrical circuits to the infrared lamps 20 and by actuating the motor of the blower unit 23. The vacuum means 15, including the perforated rollers 17, reduce the air pressure within the space 14 to a level considerably lower than the ambient pressure outside of the helmet 11. The seal 12 prevents cross-communication between the regions of different air pressure. The rollers 17 are placed as close to the hair to be dried as possible. The vacuum created by the vacuum means 15 reduces the local vapor pressure of the gaseous molecules adjacent to the liquid particles present in the wet hair. Simultaneously, the infrared radiation from the lamps 20 imparts vibrational energy to the liquid molecules and enhances the escape of such molecules from the liquid. The moisture laden air or fluid is removed through the flexible conduit 22 in the FIG. 1 embodiment and through the discharge conduit 31 in the FIG. 2 embodiment. It has been found that the removal of water from human hair by the combination of reduced pressure and infrared radiation may be accomplished in a relatively short time.

Figure 3:
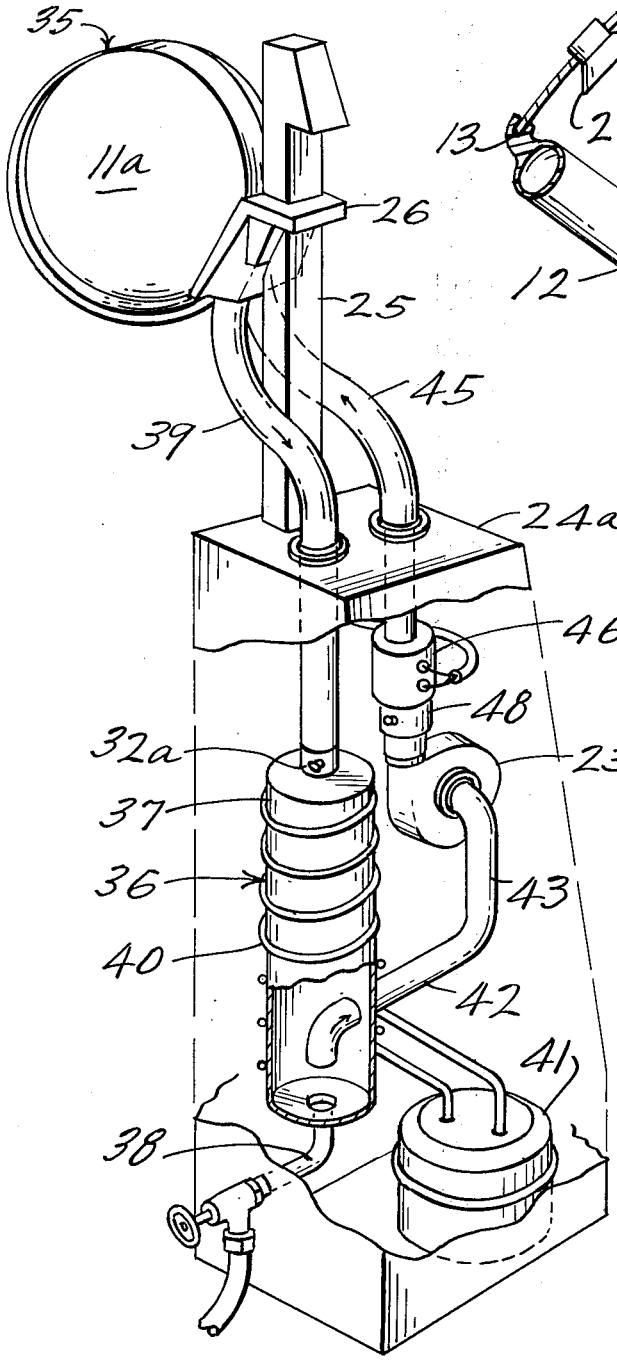
FIG. 3 is a perspective view showing another embodiment of hair dryer apparatus, according to the present invention, which is particularly adaptable for a commercial establishment.
Figure 4:
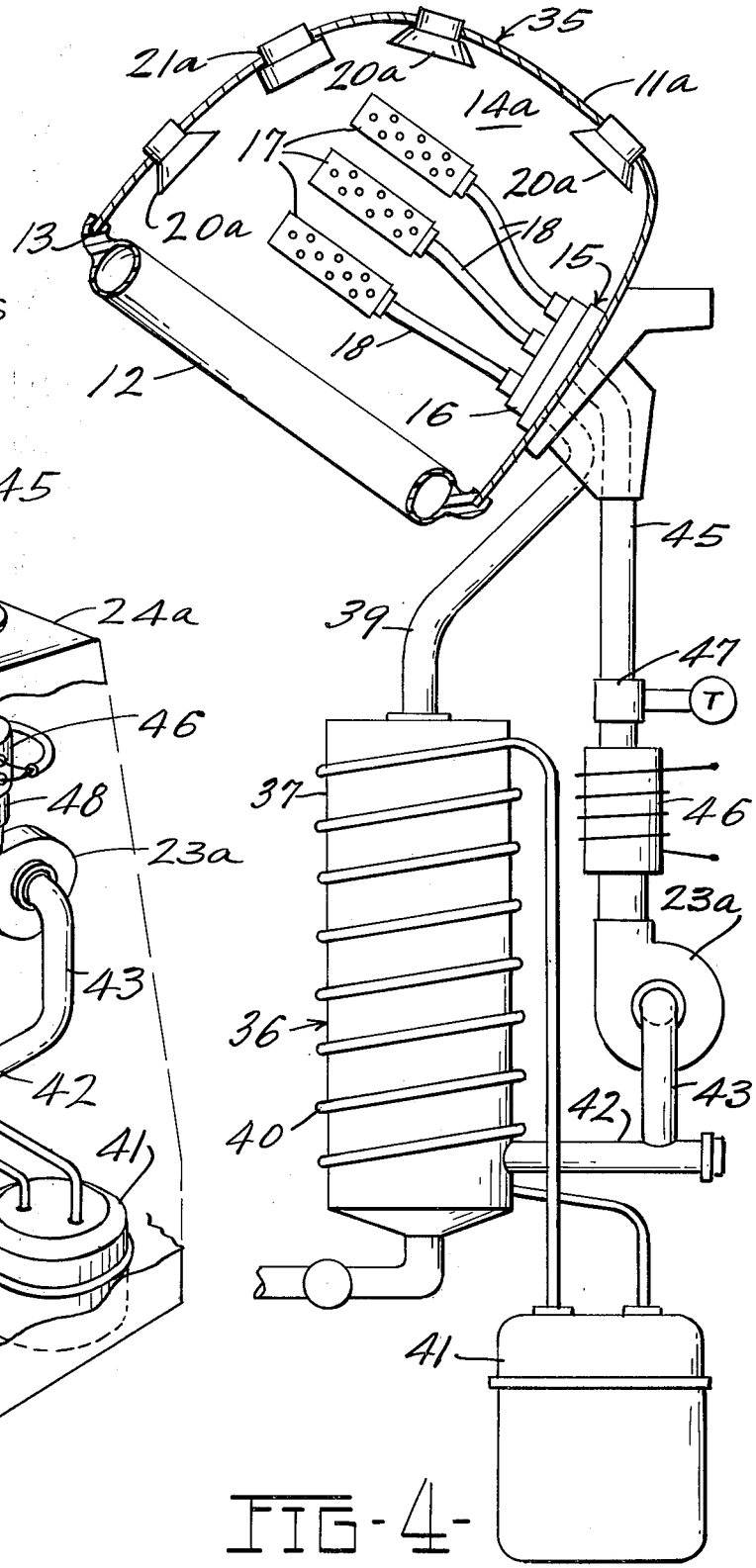
FIG. 4 is a side elevational view of the hair dryer apparatus shown in FIG. 3.

Another embodiment of hair drying apparatus, according to the present invention, is generally indicated in FIGS. 3 and 4 by the reference number 35. The hair drying apparatus 35 contains many of the components described above, and such components have been given the same reference numbers in the drawings. Dehumidifier means, generally indicated by the reference number 36, is positioned between the vacuum means 15 and the blower 23. In the present embodiment, the dehumidifier means 36 comprises a cold chamber 37 having a water drain line 38 attached at its lower end.

A conduit 39 extends between the vacuum means 15 and the top of the cold chamber 37. A safety switch 32*a* is positioned at the discharge end of the conduit 39 to monitor the temperature within such conduit and to open the electrical circuit to the infrared lamps 20*a* when the temperature within the space 14*a* reaches a predetermined level.

The dehumidifying means 36 also includes cooling coils 40 which surround the cold chamber 37 and are in communication with a motor driven compressor unit 41. The dehumidifier means 36 removes the moisture from the moisture laden fluid and the dried air is discharged through conduits 42 and 43 to the blower unit 23*a*. Water is discharged through the water drain line 38.

In the present embodiment, rather than being expelled to atmosphere, the dried air is recirculated through a return conduit 45 and discharged into the interior of the helmet 11*a*. The temperature of the recirculating air is lowered during its passage through the dehumidifier means 36 and a heater 46 is preferably provided in the return conduit 45 adjacent the discharge of the blower 23*a*. Preferably vent means are provided on the blower 23*a* to allow the pressure within the system to be reduced by blowing excess air to atmosphere when necessary. As shown in FIG. 4, a switch and thermocouple unit 47 is positioned in the return conduit 45 adjacent the heater 46. The switch and thermocouple unit 47 monitors the temperature of the recirculating air within the return conduit 45 and is electrically connected to the heater 46. The heater 46 warms the recirculated air to a temperature which does not result in a thermal shock to the user, for example, to a temperature of approximately 110°F.

While the apparatus of the embodiment shown in FIG. 4 has one helmet 11*a*, a plurality of such helmets (not shown) may be interconnected to the housing 24*a* and the equipment enclosed therein by the use of a common header (not shown).

The embodiment shown in FIGS. 3 and 4 also includes a pressure responsive valve 48 which is in communication with the return conduit 45. The valve 48 serves as a regulating air pressure valve. Again, if the pressure within the space 14*a* drops to a predetermined level, the pressure relief valve 21*a* vents the space 14*a* to atmosphere. In addition, make-up air is supplied through the valve 21*a*.

Figure 5:
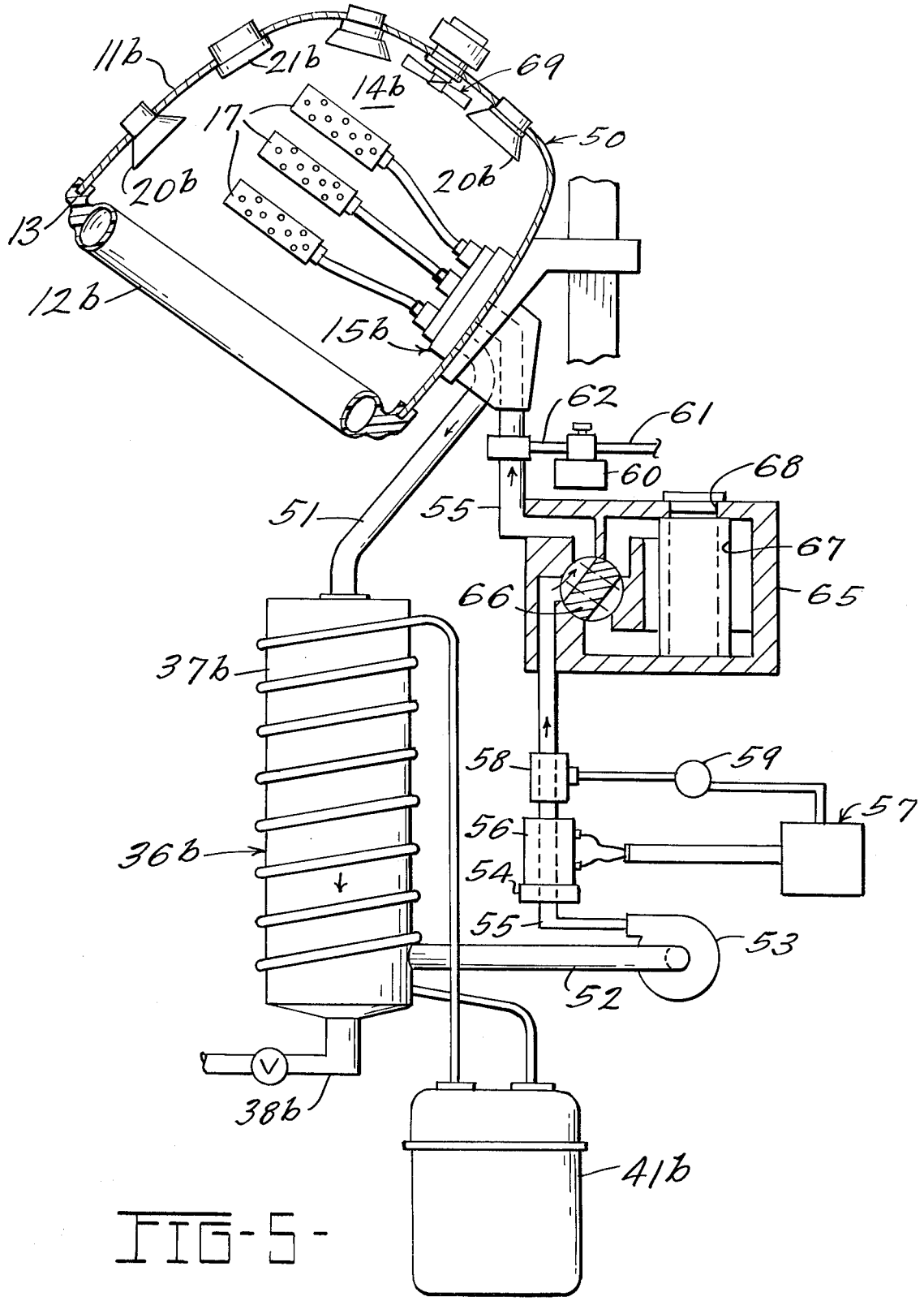
FIG. 5 is still another embodiment of hair dryer apparatus, according to the present invention.

Still another embodiment of hair drying apparatus, according to the present invention, is generally indicated by the reference number 50 in FIG. 5. The hair drying apparatus 50 includes a helmet 11*b*, mounting thereon infrared lamps 20*b*, a pressure relief valve 21*b*, a seal member 12*b* and vacuum means 15*b*. A conduit 51 removes moisture laden fluid from the space 14*b* and directs the fluid through a cold chamber 37*b* which is part of a dehumidifier means 36*b*. The fluid is dehumidified and cooled as it passes through the cold chamber 37*b* and the dried air is removed through a conduit 52 which is connected to the intake of a blower 53. A valve 54 is mounted in communication with a blower discharge conduit 55 on the discharge side of the blower 53. The valve 54 is a two-way valve and has a discharge port which is vented to atmosphere.

A heater unit 56 heats the recirculated air traveling through the conduit 55 and is operated by a control unit 57 which includes a thermocouple 58 which senses the temperature of the recirculated air and a switch 59 which is operated by the thermocouple 58. When the thermocouple 58 senses a temperature of recirculated air below a predetermined temperature, the switch 59 is actuated and the control unit 57 energizes the heater 56.

A co-solvent container 60 is in fluid communication with the conduit 55. Air under pressure, through a supply line 61, induces vaporized co-solvent to enter the conduit 55 through a line 62 where the co-solvent mixes with the recirculated air. The co-solvent assists in moisture evaporation. Low molecular weight alcohols and ethers function as satisfactory co-solvents in the hair drying method.

A supplemental dehumidifying apparatus is provided in this embodiment. More specifically, a desiccant unit 65 is positioned between the heater 56 and the co-solvent container 60. The desiccant unit 65 is used as an auxiliary dehumidifying means if the relative humidity of the make-up air becomes so high that the primary cold chamber 37 does not sufficiently dehumidify the recirculated air. A two-way valve 66 is provided. In its first position, as shown in FIG. 5, the two-way valve 66 bypasses a desiccant chamber 67 and the recirculated air is discharged directly into the space 14*b* defined by the helmet 11*b*. In its second position, the valve directs the recirculated air through the desiccant chamber 67 and then into the space 14*b*. Many types of desiccants may be used within the chamber 67. For example, silica gel is a satisfactory desiccant. An entrance port 68 is provided to the desiccant chamber 67 so that the desiccant may be removed and regenerated for future use. In the present embodiment, a fan unit 69 is mounted on the helmet 11*b* and serves to circulate air within the space 14*b*.

In operation, the hair drying apparatus 50 is actuated by closing the electrical circuits to the infrared lamps 20*b*, the compressor unit 41*b*, the blower 53, the heater unit 56 and the circulating fan 69.

The vacuum means 15*b*, including the perforated rollers 17, reduces the air pressure within the space 14*b* to a level lower than the surrounding atmosphere. The seal 12*b* retards cross-communication between the regions of different air pressure.

The vacuum created by the vacuum means 15*b* reduces the local vapor pressure of the gaseous molecules adjacent the liquid particles present in the wet hair. The infrared radiation from the lamps 20*b* imparts vibrational energy to the liquid molecules and enhances the escape of such molecules from the liquid.

The co-solvent which is introduced into the recirculating air stream is more volatile than the water and vaporization of the co-solvent increases the evaporation rate of the water vapor within the space **14*b***. The use of infrared radiation, a vacuum and the co-solvent greatly increases the rate of evaporation when compared to heat alone.

The moisture laden fluid is removed from the space **14*b* and passes through the cold chamber 37*b* where the air stream is dried. The air stream then passes through the blower 53. Excess air is dicharged through the valve 54 and the remaining air is discharged through the conduit 55 where it is heated by the heater 56. If needed, the recirculated air is circulated through the desiccant chamber 67 of the desiccant unit 65.**

Co-solvent is then introduced into the recirculated air stream from the container 60 and the mixture introduced into the space **14*b*. Periodically, the valve 48** is opened and make-up air is introduced into the system.

Hair drying apparatus, according to the present invention, greatly reduces the time needed to dry hair.

What we claim is:

1. A method of drying hair comprising the steps of establishing an enclosed space surrounding the hair to be dried separate and sealed from atmosphere, reducing the air pressure within and throughout such space to a sub-atmospheric pressure below ambient pressure, maintaining the sub-atmospheric pressure throughout the space and applying infrared radiation to the hair.

2. A method of drying hair, according to claim 1, including removing air and moisture from such space.

3. A method of drying hair, according to claim 2, including recirculating at least a portion of the air removed from the space and removing moisture from such recirculated air.

4. A method of drying hair, according to claim 3, including heating such recirculated air.

5. A method of drying hair, according to claim 3, including removing moisture from the hair by both evaporation and with a chemical desiccant.

6. A method of drying hair, according to claim 3, including the addition of a co-solvent, which is more volatile than water, to the recirculated air.

7. Apparatus for drying hair comprising, in combination, a helmet having an open end, said helmet defining an enclosed space adjacent the hair to be dried sealing means adjacent said open end of said helmet for separating said enclosed space from the atmosphere, vacuum means including a vacuum head mounted within such space and vacuum pump means located exterior of such space in fluid communication with said vacuum head for reducing the air pressure throughout such space, wherein a sub-atmospheric pressure is maintained throughout such space during drying and infrared means within such space for directing radiant energy toward the hair.

8. Apparatus for drying hair, according to claim 7, wherein said pump means removes moisture laden air from such space.

9. Apparatus for drying hair, according to claim 7, including pressure relief means adjacent said helmet and in communication with such space and the atmosphere, whereby such space is vented to the atmosphere when the pressure within such space drops to a predetermined pressure level.

10. Apparatus for drying hair, according to claim 8, wherein said infrared means comprises at least one infrared lamp mounted within said helmet.

11. Apparatus for drying hair, according to claim 10, wherein said vacuum head has openings defined therethrough.

12. Apparatus for drying hair, according to claim 10, wherein said vacuum means includes a manifold mounted within said helmet and a plurality of rollers positioned adjacent the hair and in fluid communication with said manifold.

13. Apparatus for drying hair, according to claim 11, wherein said pump means comprises a blower and a conduit between said vacuum means and said blower.

14. Apparatus for drying hair, according to claim 13, including dehumidifier means positioned between said vacuum means and said blower for removing moisture from the fluid removed from said helmet.

15. Apparatus for drying hair, according to claim 14, wherein said dehumidifier means comprises a cold chamber which receives the moisture laden air, cooling coils surrounding said cold chamber and a condenser unit in communication with said cooling coils.

16. Apparatus for drying hair, according to claim 14, including second conduit means between said blower and said helmet for recirculating dried air to said helmet.

17. Apparatus for drying hair, according to claim 14, wherein said dehumidifier means includes a chemical desiccant unit.

18. Apparatus for drying hair, according to claim 16, including heating means in communication with said second conduit means for heating the recirculating air.

19. Apparatus for drying hair, according to claim 16, including co-solvent means in communication with said second conduit means for adding a co-solvent to the recirculating air.

* * * * *